US006931852B2

(12) United States Patent
Yatsuzuka et al.

(10) Patent No.: US 6,931,852 B2
(45) Date of Patent: Aug. 23, 2005

(54) STEAM ENGINE

(75) Inventors: Shinichi Yatsuzuka, Chiryu (JP); Yasumasa Hagiwara, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/645,944

(22) Filed: Aug. 22, 2003

(65) Prior Publication Data

US 2004/0060294 A1 Apr. 1, 2004

(30) Foreign Application Priority Data

Aug. 26, 2002 (JP) ..... 2002-245165

(51) Int. Cl.[7] ..... F01B 29/00; F01K 1/00; F01K 21/00; F15B 21/04

(52) U.S. Cl. ..... 60/670; 60/531; 60/675

(58) Field of Search ..... 60/670, 675, 531, 60/530, 517–526, 516

(56) References Cited

U.S. PATENT DOCUMENTS 4,489,553 A * 12/1984 Wheatley et al. ..... 60/516
4,546,608 A * 10/1985 Shiina et al. ..... 60/531
5,537,820 A 7/1996 Beale et al. ..... 60/517
5,771,693 A * 6/1998 Coney ..... 60/595
5,927,071 A * 7/1999 Asanuma et al. ..... 60/531
6,470,679 B1 10/2002 Ertle ..... 60/530

FOREIGN PATENT DOCUMENTS

| | | | |
|---|---|---|---|
| DE | 199 39 143 | 2/2001 | ..... F24F/5/00 |
| EP | 1 017 933 | 7/2000 | ..... F02G/1/02 |
| GB | 2 114 673 | 8/1983 | ..... F02G/1/053 |
| JP | 55-60707 | 5/1980 | |
| JP | 7-180649 | 7/1995 | |

* cited by examiner

*Primary Examiner*—Sheldon J Richter
(74) *Attorney, Agent, or Firm*—Harness, Dickey & Pierce, PLC

(57) ABSTRACT

A steam engine increases efficiency and prevents corrosion, abrasion, and the like in a part receiving steam pressure. A heater and a cooler are provided on one side of a U-shaped fluid container, and a piston for output is provided on its other side. The heater heats working fluid to vaporize the fluid. The expansion pressure of steam of the working fluid depresses a fluid level in a first vertical pipe. The liquid component of the working fluid flows from the first vertical pipe into a second vertical pipe, thereby applying pressure to the piston in an upward direction. Then, the liquid component of the working fluid functions as a liquid piston directly receiving the expansion pressure of the steam, so that it is possible to prevent the occurrence of corrosion, abrasion and the like in the part receiving steam pressure.

11 Claims, 11 Drawing Sheets

STEAM ENGINE

CROSS REFERENCE TO RELATED APPLICATION

This application is based upon, claims the benefit of priority of, and incorporates by reference, the contents of Japanese Patent Application No. 2002-245165 filed Aug. 26, 2002.

BACKGROUND OF THE INVENTION

1. Field of the Invention

The present invention relates to a steam engine that converts thermal energy into mechanical energy.

2. Description of the Related Art

A heat power plant and the like utilize a steam engine based upon a Rankine cycle in which a generated superheated steam is isentropically expanded in a steam turbine to extract mechanical energy. Then, the steam expanded in the steam turbine is cooled and condensed. Condensed liquid is isentropically compressed and heated for vaporization, to regenerate the superheated steam.

In the above steam engine, the degree of superheat of the steam increases before expansion for the purpose of preventing part of the steam from liquefying due to a decrease in dryness of the working fluid in the steam turbine when the steam is isentropically expanded therein. However, as shown in a T-s diagram (temperature-entropy diagram) of FIG. 12, it is difficult to perfectly prevent the emergence of water droplets in the steam turbine.

In a converting process of expansion energy of the steam turbine and the like into mechanical energy, the emergence of the water droplets induces corrosion and abrasion in a part that receives steam pressure, such as a turbine blade, a piston, and the like. Accordingly, in the steam engine (a motive power plant) using the Rankine cycle, the steam must be generally expanded in such a manner that the dryness does not decrease to 90% or less. Therefore, it is difficult to increase the mechanical energy taken out of the thermal energy, that is, to efficiently convert the energy.

SUMMARY OF THE INVENTION

Considering the foregoing problem, an object of the present invention is to provide a new steam engine which can solve the problem of corrosion, abrasion, and the like in parts receiving steam pressure.

To achieve the foregoing object, the present invention according to a first aspect is a steam engine for converting thermal energy into mechanical energy at an output portion. The steam engine is constructed of a fluid container (11) for flowably containing fluid, a heater (12) for heating the fluid contained in the fluid container (11), and a cooler (13) for cooling steam vaporized by being heated by the heater (12). The cooler (13) is disposed below the heater (12) in the direction of gravity's acceleration. Expansion pressure of the steam displaces flowing liquid to output the mechanical energy. The cooler (13) cools and liquefies the steam to displace the fluid contained in the fluid container (11) with self-excited vibration.

Accordingly, since the liquid component of the fluid functions as a liquid piston which directly receives the expansion pressure of the steam, it is possible in principle to prevent the occurrence of corrosion, abrasion, and the like in parts receiving steam pressure. Since the liquid component of the fluid, namely the liquid piston, receives the expansion pressure of the steam, it is unnecessary to employ means to increase the degree of superheat of the steam in advance for the purpose of preventing the occurrence of droplets due to a decrease in the degree of superheat when the steam expands. Accordingly, it is possible to increase energy conversion as high as the efficiency of a Carnot cycle.

The present aspect of the invention makes it possible to increase the energy conversion efficiency as high as Carnot cycle without generating superheated steam, and does not contradict the generation of the superheated steam.

According to a second aspect of the invention, the steam engine has an exciting means (15) which is disposed on a heater (12) side. The exciting means (15) applies a periodical exciting force to the fluid contained in the fluid container (11). Thus, it is possible to efficiently take out the mechanical energy as output, with the use of resonance of the fluid.

According to a third aspect of the invention, the exciting force is a reaction force of compressed gas charged in a gastight enclosure, and the exciting means (15) applies the exciting force to the fluid contained in the fluid container (11).

According to a fourth aspect of the invention, the exciting means (15) applies force to the fluid contained in the fluid container (11) in a cycle out of phase with a cycle of the self-exciting vibration generated in the fluid container (11).

Thus, since time for heat exchange between the heater (12) or cooler (13) and the fluid is extended, an amount of heat exchange between the heater (12) or cooler (13) and the fluid increases. Therefore, it is possible to increase the operational efficiency, that is, the energy conversion efficiency of the steam engine.

According to a fifth aspect of the invention, the exciting means (15) applies force to the fluid contained in the fluid container (11) in a cycle one-quarter cycle out of phase with a cycle of the self-exciting vibration generated in the fluid container (11).

According to a sixth aspect of the invention, the exciting means has a first gas chamber (15) for containing a gas for directly applying the exciting force to the fluid contained in the fluid container (11) and a second gas chamber **(15*a*) coupled to the first gas chamber (15) via throttle means (15*b*) for generating a predetermined flowing resistance. Thus, since the time for heat exchange between the heater (12) or cooler (13) and the fluid is extended, an amount of heat exchange between the heater (12) or cooler (13)** and the fluid increases. Therefore, it is possible to increase the operational efficiency (energy conversion efficiency) of the steam engine.

According to a seventh aspect of the invention, a regenerator (16) is provided between the heater (12) and the cooler (13). The regenerator (16) exchanges heat in the fluid contained in the fluid container (11). Of the thermal energy supplied to the fluid by the heater (12), only the energy of steam pressure, namely the energy of the expansion pressure is taken out as the mechanical energy. The thermal energy absorbed from the fluid by the cooler (13) cannot be taken out as the mechanical energy.

In the present invention, on the contrary, since the regenerator (16) for exchanging heat in the fluid is disposed between the heater (12) and the cooler (13), the vaporized fluid expands and flows from the heater (12) to the cooler (13) while supplying heat to the regenerator (16). The fluid cooled by the cooler (13), on the other hand, flows from the cooler (13) to the heater (12) in expansion while being heated by the regenerator (16), the heat source of which is heat supplied to the regenerator (16).

Accordingly, in this invention, the heat energy is reused for heating, though it has been released as waste heat by the cooler (13) into the atmosphere. An amount of heat energy charged into the steam engine is reduced, so that it is possible to increase the operational efficiency (energy conversion efficiency) of the steam engine.

According to an eighth aspect of the invention, the fluid container (11) is formed approximately in the shape of a U so that a bent pipe (11*a*) is positioned in the lowermost part thereof. The liquid is displaced back and forth in the bent pipe (11*a*) with self-excited vibration.

According to a ninth aspect of the invention, the fluid container (11) is formed in a double cylindrical shape so as to have an outer cylinder (11*d*) and an inner cylinder (11*e*) coupled to each other in the lower portions thereof. The fluid is displaced back and forth in a coupling tube (11*f*) for coupling the outer cylinder (11*d*) and the inner cylinder (11*e*) with self-excited vibration. Thus, it is possible to miniaturize the fluid container (11).

According to a tenth aspect, the present invention is a steam engine for converting thermal energy into mechanical energy. The steam engine has a fluid container (11) forming a ring-shaped fluid path, a heater (12) for heating fluid contained in the fluid container (11), a cooler (13) disposed above the heater (12) to cool steam vaporized by being heated by the heater (12), and an output portion (14, 14*a*, 14*b*) provided in the fluid container (11). The output portion (14, 14*a*, 14*b*) outputs displacement of self-excited vibration generated in liquid contained in the fluid container (11) as the mechanical energy.

The boiled and vaporized steam, by being superheated by the heater (12), flows upward with expansion and then is condensed and liquefied by being cooled by the cooler (13). Accordingly, the fluid repeating the expansion and contraction in the fluid container (11) is microscopically displaced with self-excited vibration. While the steam cooled by the cooler (13) liquefies, the steam continuously flows from the heater (12) to the cooler (13). Therefore, in the whole working fluid, namely macroscopically observing the working fluid, the fluid circulates through the fluid container (11) in such a manner as to flow from the heater (12) to the cooler (13).

As described above, in the present aspects of the invention, it is possible in principle to prevent the occurrence of corrosion, abrasion, and the like in the part receiving steam pressure, because the liquid component of the fluid functions as the liquid piston that directly receives the expansion pressure of the steam. Since the liquid component of the fluid, namely the liquid piston, receives the expansion pressure of the steam, it is unnecessary to employ means to increase the degree of superheat of the steam in advance for the purpose of preventing the occurrence of droplets due to a decrease in the degree of superheat when the steam expands. Accordingly, it is possible to increase the efficiency of energy conversion as high as a Carnot cycle.

According to an eleventh aspect of the invention, the steam engine further has a flow rate control means (17) for periodically varying the flow rate of the fluid circulating through the fluid container (11).

Thus, time for heat exchange between the heater (12) or cooler (13) and the fluid extends, so that an amount of heat exchange between the heater (12) or cooler (13) and the fluid increases. Therefore, it is possible to increase the operational efficiency, that is, the energy conversion efficiency of the steam engine.

According to a twelfth aspect of the invention, the fluid container (11) formed in a double cylindrical shape has an outer cylinder (11*d*) and an inner cylinder (11*e*) coupled to each other in the upper and lower portions thereof. Therefore, it is possible to miniaturize the fluid container (11).

The parenthesized numerals accompanying the foregoing individual means correspond with those of the detailed description to be described later. Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

First Embodiment

Figure 1:
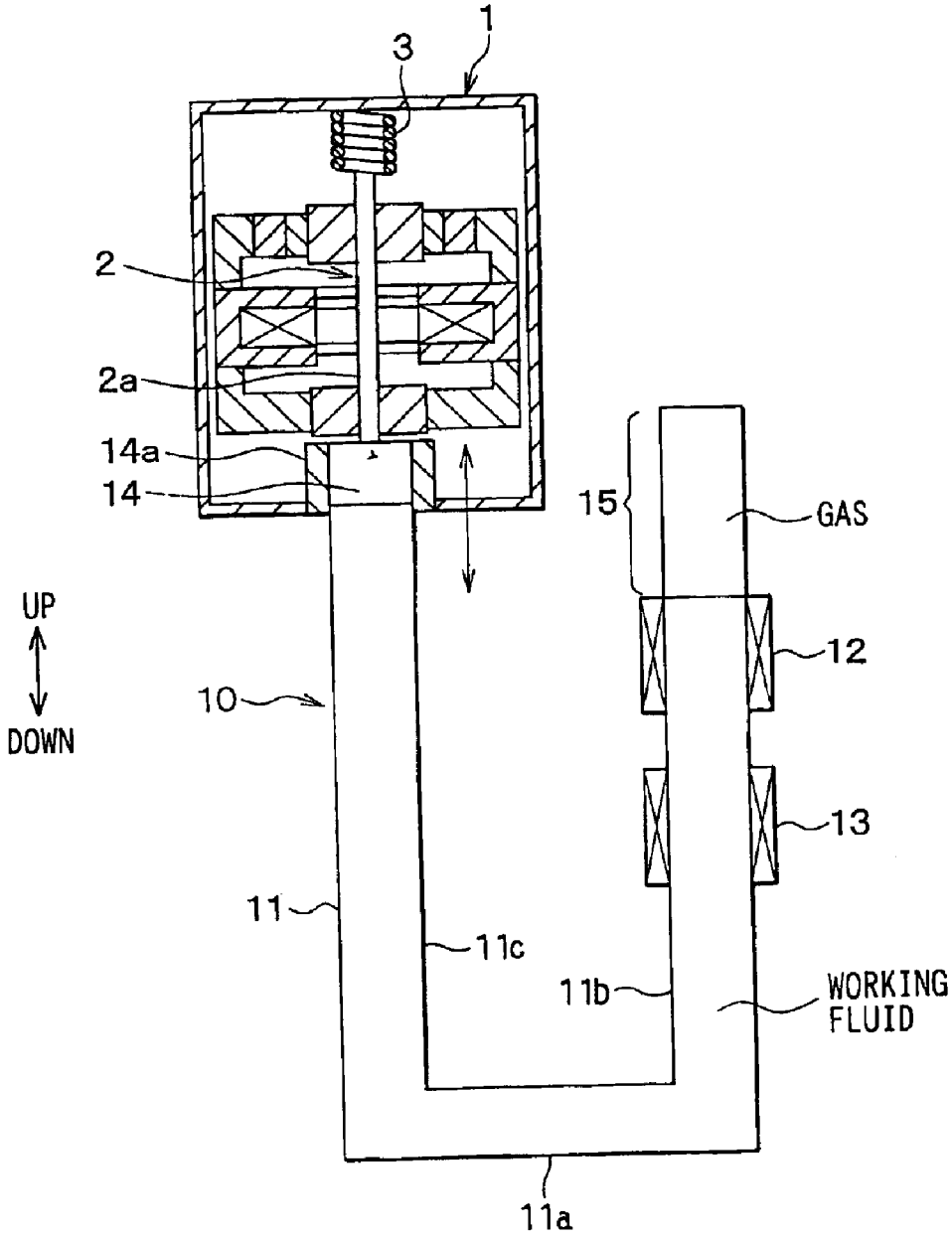
FIG. 1 is a schematic and partial cross-sectional view of a generator set according to a first embodiment of the present invention.
Figure 2:
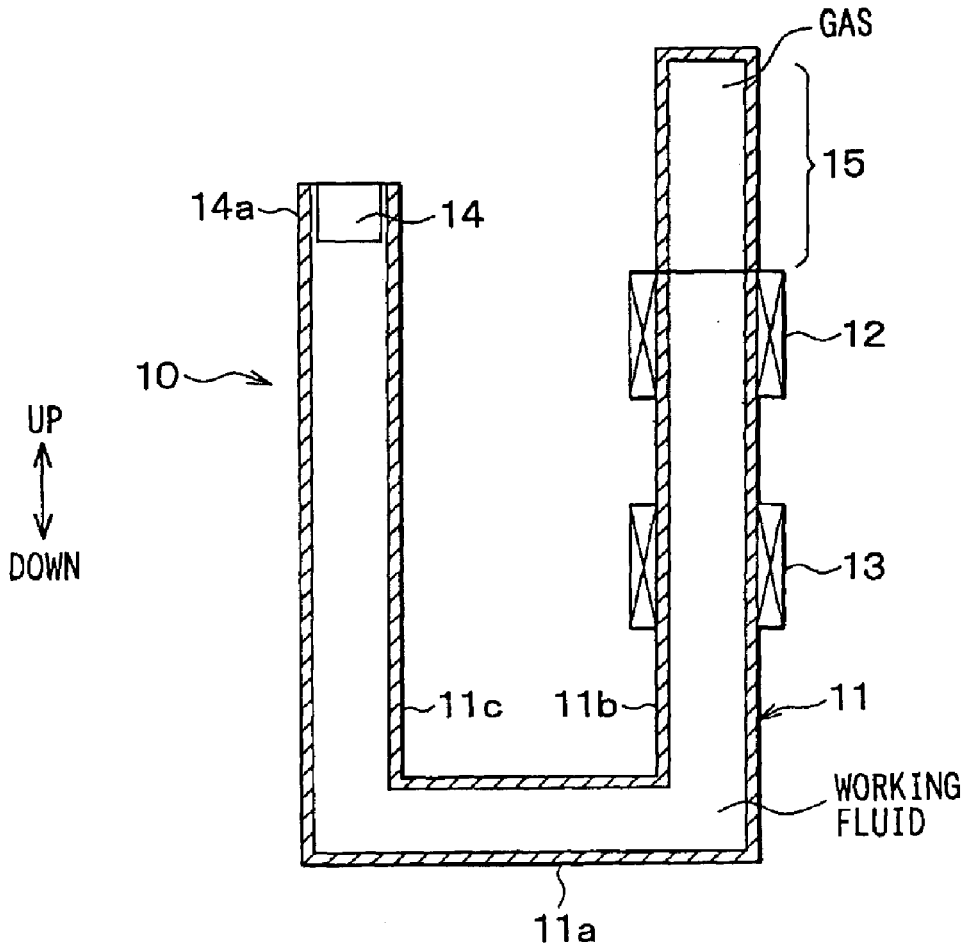
FIG. 2 is a schematic view of a steam engine according to the first embodiment of the present invention.

In a first embodiment of the present invention, a steam engine is applied to a linear motor for displacing a mover 2 in a generator 1, with vibration. FIG. 1 is a schematic view of a generator set which comprises a steam engine 10 and a generator 1, and FIG. 2 is a schematic view of the steam engine 10 alone. The generator 1 according to the present invention is a linear vibration actuator which generates electromotive force by displacing the mover 2, having a buried permanent magnet, with vibration. The steam engine 10 has a fluid container 11 in which freely flowing working fluid is contained, a heater 12 for heating the fluid in the fluid container 11, a cooler 13 for cooling steam which is heated and vaporized by the heater 12, and the like.

It is preferable that the fluid container 11 be made of a heat insulation material, except for parts opposed to the heater 12 and the cooler 13. As the working fluid is water in this embodiment, the fluid container 11 is made of a stainless material. The parts of the fluid container 11, as opposed to the heater 12 and the cooler 13, are made of copper or aluminum which have a higher thermal conductivity than stainless.

The fluid container 11 is an approximately U-shaped pipe pressure container having a bent, bottom pipe 11*a*, and first and second vertical pipes 11*b* and 11*c*. The first vertical pipe 11*b* is connected to one end of the bent, bottom pipe 11*a* in a horizontal direction (a right side of the drawing). The first vertical pipe 11*b* is provided with the heater 12 and the cooler 13 in such a manner that the heater 12 is positioned above the cooler 13.

A cylinder portion 14*a* is provided in an upper end of the second vertical pipe 11*c*, which is connected to the other end of the bent pipe 11*a* in the horizontal direction (a left side of the drawing). A piston 14, which is displaced in accordance with pressure from the working fluid, is slidably fitted into the cylinder portion 14*a*.

The piston 14, as shown in FIG. 1, is coupled to one end of a shaft 2*a* of the mover 2. A spring 3, as an elastic member for generating elastic force to bias the mover 2 toward the piston 14, is provided on the other end of the shaft 2*a*, opposite to the piston 14, and beyond the mover 2.

A gas chamber 15, as a gastight enclosure for containing inert gas that does not react with the working fluid such as nitrogen, helium, and the like, is provided in the fluid container 11, near and normally above the heater 12. The compression reaction force of gas charged into the gas chamber 15 applies periodical exciting force (elastic force) to the fluid contained in the fluid container 11. In other words, in this embodiment, the gas chamber 15 functions as an exciting means that applies the periodical exciting force to the fluid contained in the fluid container 11.

The principles and characteristics of the steam engine 10 according to the present embodiment will now be described.

Figure 3:
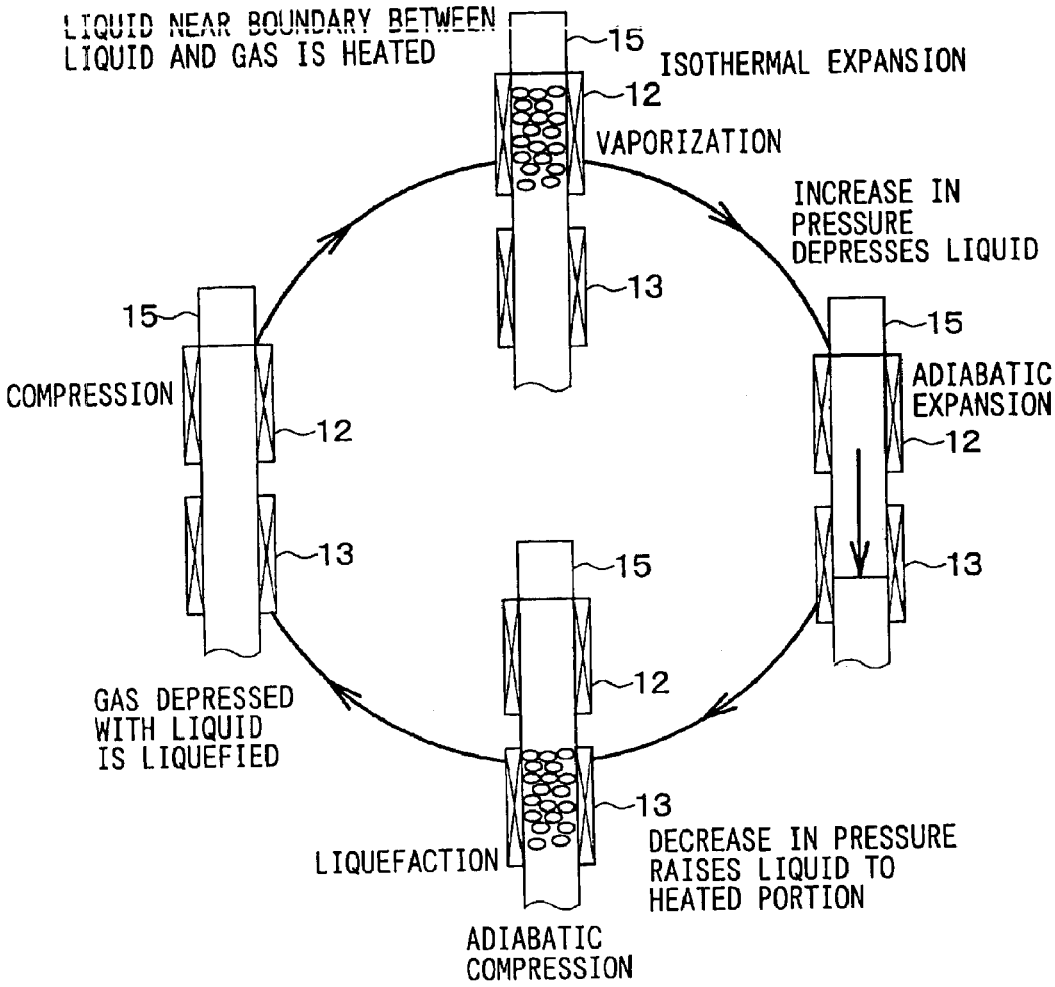
FIG. 3 is an explanatory view explaining the operation of the steam engine according to the first embodiment of the present invention.

FIG. 3 is an explanatory view showing the principles of the steam engine 10. The steam of the working fluid, heated and vaporized by the heater 12, depresses a fluid level of the first vertical pipe 11*b* with its expansion pressure. Then, the liquid component of the working fluid, flowing from the first vertical pipe 11*b* into the second vertical pipe 11*c*, applies pressure to the piston 14 in the pushing, that is, the upward direction thereof. Accordingly, since the piston 14 is displaced against the elastic force of the spring 3 and magnetic force applied to the mover 2, mechanical energy is output from the steam engine 10 to the generator 1.

At this time, in this embodiment, since the liquid component of the working fluid functions as a liquid piston which directly receives the expansion pressure of the steam, it is possible in principle to prevent the occurrence of corrosion, abrasion, and the like in a part receiving steam pressure.

The liquid component of the working fluid that directly receives the expansion pressure of the steam, as described above, includes a case, for example, where the steam pressure is applied to the liquid piston which is partitioned from the steam component of the working fluid with a membrane.

Since the liquid component of the working fluid, namely a liquid piston, receives the expansion pressure of the steam, it is unnecessary to employ means to increase the degree of superheat of the steam in advance, for the purpose of preventing the occurrence of droplets due to decrease in the degree of superheat when the steam expands. Accordingly, it is possible to increase energy conversion efficiency as high as a Carnot cycle.

In this embodiment, since the steam component of the working fluid is not partitioned from the liquid piston with the membrane, the generated steam is not superheated steam but saturated steam, as long as the whole working fluid in the fluid container 11 is not vaporized. When the steam generated by the heater 12 reaches the cooler 13 by expansion, the steam cooled by the cooler 13 is condensed and liquefied. Then, a force depressing the fluid level in the first vertical pipe 11*b* (the expansion pressure) vanishes, so that the fluid level in the first vertical pipe 11*b* rises.

Thus, the working fluid in the fluid container 11 outputs mechanical energy to the outside, that is to the generator 1 in this embodiment, by flowing back and forth in the bent pipe 11*a* with self-excited vibration. In this first embodiment, the natural frequency, namely the number of self-excited vibrations of the liquid piston, of a vibration system composed of a gas spring formed by the gas chamber 15 and the liquid piston is suitably set for operating the generator 1. Therefore, a generator set efficiently operates.

Second Embodiment

Figure 4:
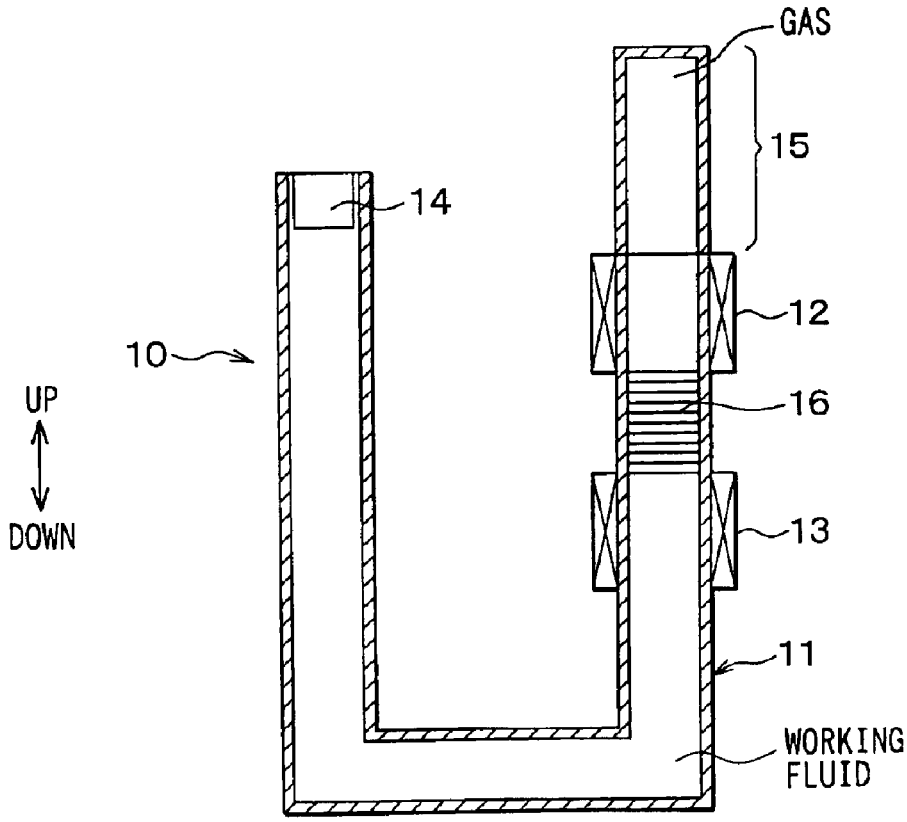
FIG. 4 is a schematic view of a steam engine according to a second embodiment of the present invention.

In a second embodiment, as shown in FIG. 4, a regenerator 16 for exchanging heat in the working fluid is provided between the heater 12 and the cooler 13. It is preferable that the regenerator 16 have a predetermined heat capacity and a high heat transfer rate to the working fluid. In the regenerator 16, it is also preferable that thermal conductivity in the orthogonal direction of the vibration direction of the working fluid be higher than that in the vibration direction thereof. In this embodiment, the regenerator 16 is made of meshed metal laminated in the vibration direction of the working fluid, metal balls stuffed in the fluid container 11, or honeycomb metal members laminated in the vibration direction of the working fluid, and the like.

The effect of this embodiment will be hereinafter described. Of the thermal energy supplied to the working fluid by the heater 12, only the energy of steam pressure (evaporating pressure), namely the energy of expansion pressure, is taken out as the mechanical energy. The thermal energy absorbed from the working fluid by the cooler 13 cannot be taken out as the mechanical energy. In the first embodiment, the thermal energy absorbed from the working fluid in the cooler 13 is released into the atmosphere as waste heat.

In this embodiment, to the contrary, since the regenerator 16 for exchanging heat in the working fluid is disposed between the heater 12 and the cooler 13, the vaporized working fluid expands and flows from the heater 12 to the cooler 13 while supplying heat to the regenerator 16. The working fluid cooled by the cooler 13, on the other hand, flows from the cooler 13 to the heater 12 in expansion while being heated by the regenerator 16, the heat source of which is heat supplied to the regenerator 16.

Accordingly, the heat energy is reused for heating in this embodiment, though it has been released by the cooler 13 into the atmosphere as the waste heat in the first embodiment. An amount of heat energy charged into the steam engine 10 is reduced compared to that of the first embodiment, so that it is possible to increase the operational efficiency, that is, the energy conversion efficiency of the steam engine 10.

Third Embodiment

In a third embodiment, the cycle of an exciting force applied by the gas chamber 15 to the working fluid is out of phase with the cycle of a self-exciting vibration generated in the fluid container 11. To be more specific, as shown in FIG. 5, an inert gas chamber 15 (hereinafter called "first gas chamber 15") for directly applying the exciting force to the working fluid in the fluid container 11 and a second gas chamber 15*a* are coupled to each other via a throttle means such as an orifice 15*b*, a capillary tube or the like which generates a predetermined flowing resistance.

In this embodiment, the volume of the second gas chamber 15*a* is higher than that of the first gas chamber 15, so that the pressure fluctuation of the second gas chamber 15*a* is sufficiently small at the orifice 15*b* as compared with the average pressure. The cycle of the exciting force applied by the first gas chamber 15 to the working fluid is approximately one-quarter cycle out of phase with the cycle of the self-excited vibration generated in the fluid container 11.

The effect of this embodiment will be hereinafter described. In this embodiment, the cycle of the exciting force applied by the gas chamber 15 to the working fluid is out of the cycle of the self-excited vibration generated in the fluid container 11. The time for heat exchange between the heater 12 or cooler 13 and the working fluid becomes long when compared with the foregoing embodiments. Accordingly, since an amount of heat exchange between the heater 12 or the cooler 13 and the working fluid increases, the operational efficiency, that is, the energy conversion efficiency of the steam engine 10 increases.

Figure 5:
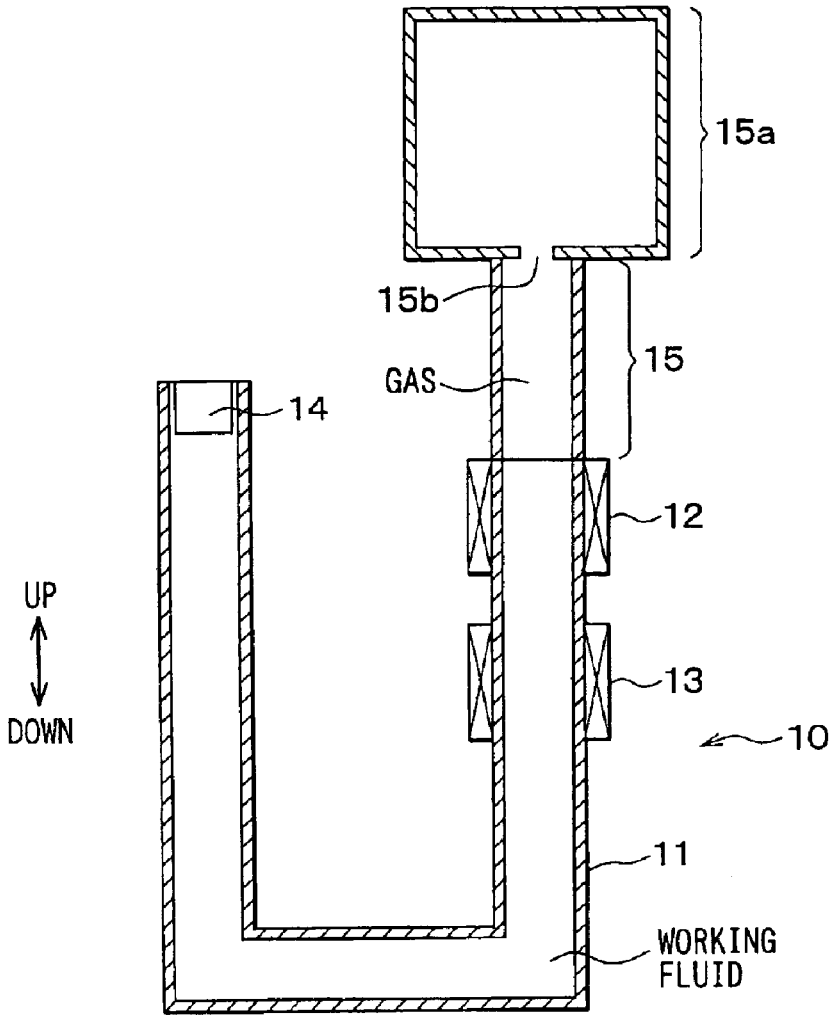
FIG. 5 is a schematic view of a steam engine according to a third embodiment of the present invention.

This embodiment is applied to the first embodiment (refer to FIG. 2) in FIG. 5, but this embodiment is also applicable to the second embodiment (refer to the fourth embodiment).

Fourth Embodiment

Figure 6A:
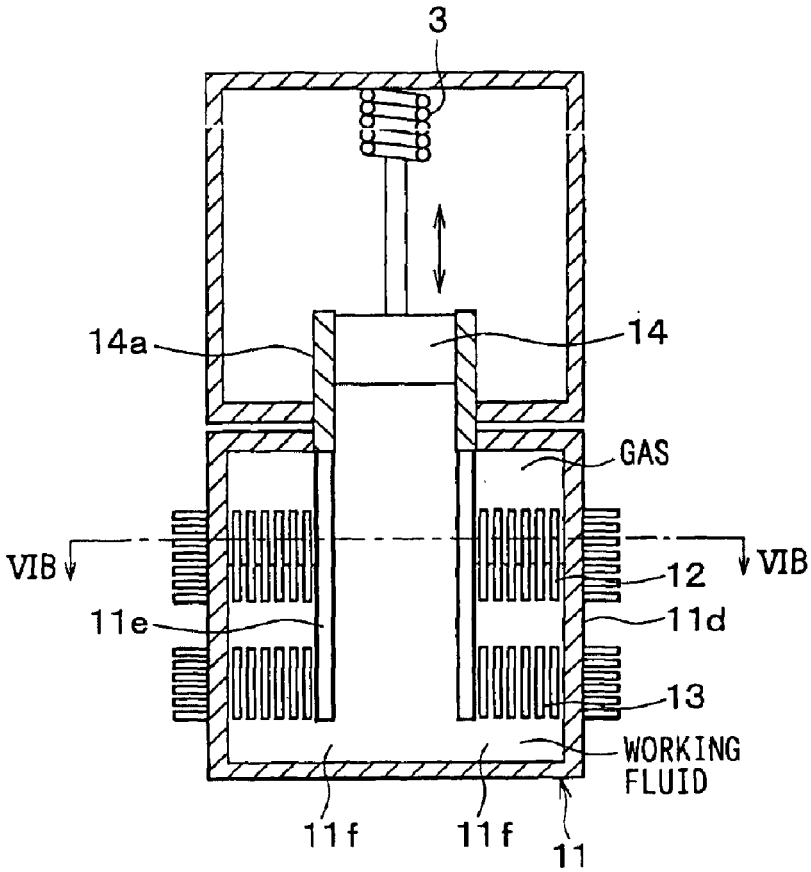
FIG. 6A is a schematic view of a generator set according to a fourth embodiment of the present invention.
Figure 6B:
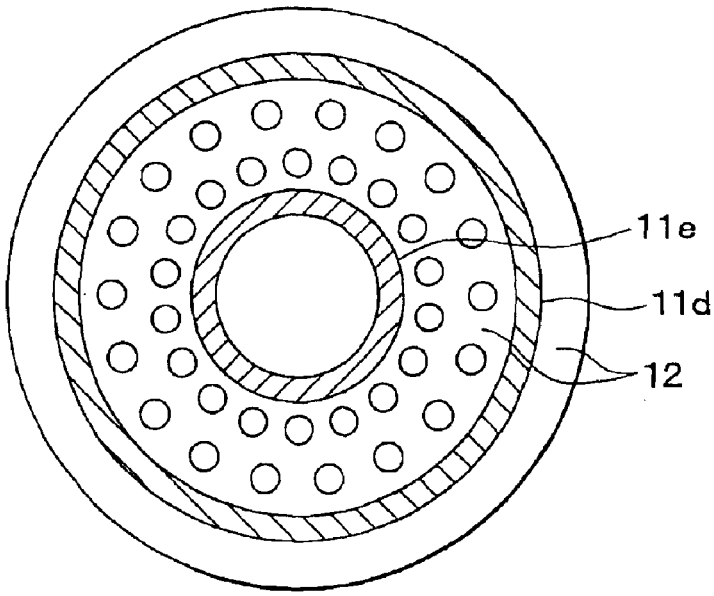
FIG. 6B is a cross-sectional view taken along the line VIB—VIB in FIG. 6A.

In the foregoing embodiments, the fluid container 11 takes the shape of approximately a "U." In this embodiment, however, as shown in FIGS. 6A and 6B, the fluid container 11 comprises a double cylinder, namely an outer cylinder 11*d* and an inner cylinder 11*e* coupled in the lower portion. The working fluid flows back and forth in a coupling tube 11*f* between the outer cylinder 11*d* and the inner cylinder 11*e* by self-excited vibration.

If the working fluid inside the inner cylinder 11*e* exchanges heat with the working fluid between the inner cylinder 11*e* and the outer cylinder 11*d*, an amount of output mechanical energy decreases due to a decrease in an amount of expansion. Thus, it is preferable to take a measure, such as to make the inner cylinder 11*e* of a material with low thermal conductivity such as stainless, titanium or the like, to make the inner cylinder 11*e* of a double pipe the inside of which is evacuated, or the like.

Fifth Embodiment

In the foregoing embodiments, the whole working fluid self-excitedly vibrates. In a fifth embodiment, the working fluid microscopically and self-excitedly vibrates by being boiled and cooled, and the displacement of self-excited vibration of the working fluid is output as the mechanical energy.

Figure 7:
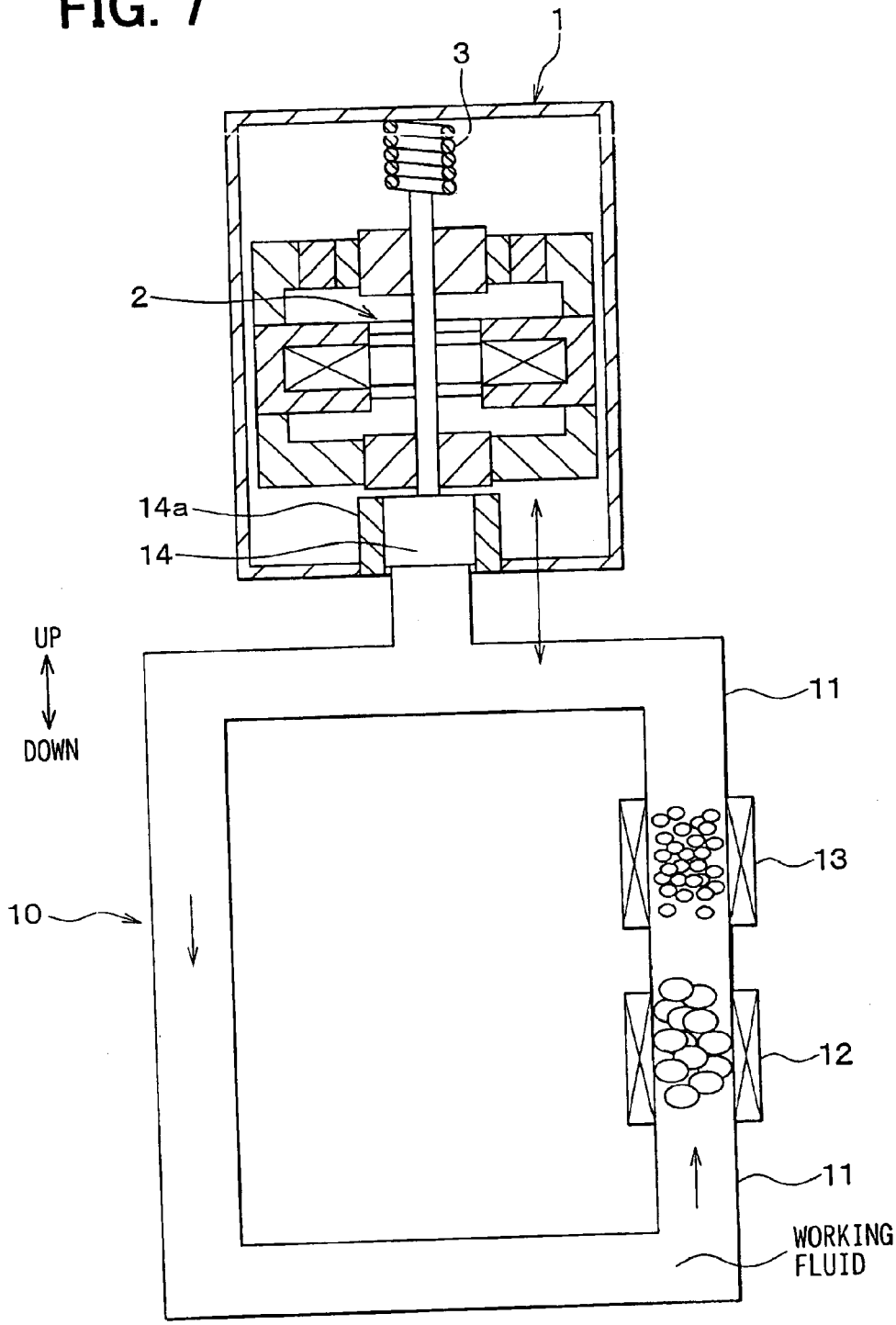
FIG. 7 is a schematic and partial cross-sectional view of a generator set according to a fifth embodiment of the present invention.

To be more specific, as shown in FIG. 7, the fluid container 11 takes the shape of a ring to form a ring-shaped fluid path. The cooler 13, for cooling the vaporized steam heated by the heater 12, is disposed above the heater 12.

In FIG. 7, the piston 14, as an output portion for outputting the displacement of self-excited vibration as the mechanical energy, is provided above the fluid container 11. However, the position of the piston 14, namely the output portion, is changeable to anywhere, except for between the heater 12 and the cooler 13. The effect of this embodiment will be hereinafter described.

The boiled and vaporized steam, by being superheated by the heater 12, flows upward with expansion and is then condensed and liquefied by being cooled by the cooler 13. In the fluid container 11, the working fluid repeating the expansion and contraction is microscopically displaced with self-excited vibration.

While the steam cooled by the cooler 13 liquefies, the steam continuously flows from the heater 12 to the cooler 13. Therefore, in the whole working fluid, namely macroscopically observing the working fluid, the working fluid circulates through the fluid container 11 in one direction in such a manner as to flow from the heater 12 to the cooler 13.

As described above, it is possible in principle to prevent the occurrence of corrosion, abrasion, and the like in the part receiving steam pressure in this embodiment too, because the liquid component of the working fluid functions as the liquid piston directly receiving the expansion pressure of the steam.

Since the liquid component of the working fluid, namely the liquid piston, receives the expansion pressure of the steam, it is unnecessary to employ means to increase the degree of superheat of the steam in advance for the purpose of preventing the occurrence of droplets due to decrease in the degree of superheat when the steam expands. Accordingly, it is possible to increase energy conversion efficiency as high as a Carnot cycle.

In this embodiment, since the working fluid circulates through the fluid container 11, the generated steam is not superheated steam but saturated steam, as long as the whole working fluid in the fluid container 11 is not vaporized.

Sixth Embodiment

Figure 8:
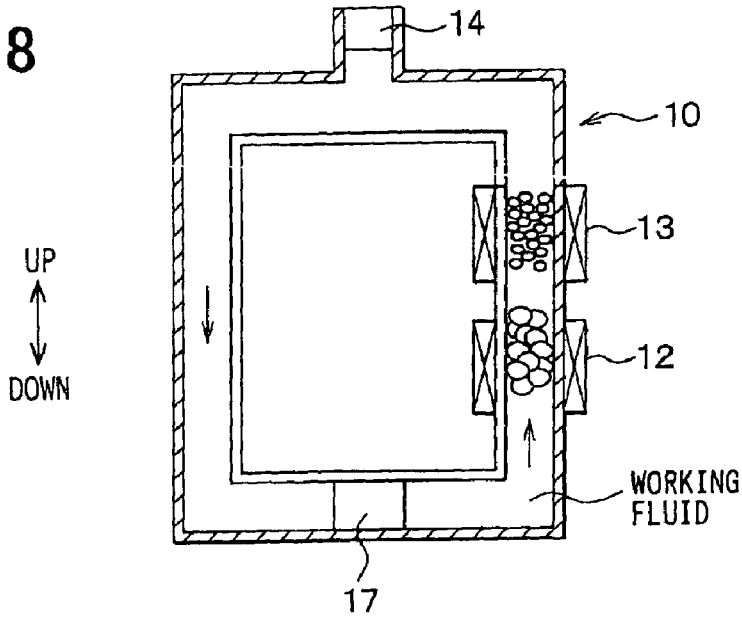
FIG. 8 is a schematic view of a steam engine according to a sixth embodiment of the present invention.

Macroscopically observing, in the steam engine 10 of the fifth embodiment shown in FIG. 7, the working fluid circulates through the fluid container 11 in one direction at a constant flow rate. In a sixth embodiment, as shown in FIG. 8, a valve 17 as a flow rate control means for periodically varying the macroscopic flow rate of the working fluid circulating through the fluid container 11 is provided in the fluid container 11. The effect of this embodiment will be hereinafter described.

When the working fluid circulates through the fluid container 11 at approximately a constant flow rate, it is difficult to extend time for heat exchange between the heater 12 or the cooler 13 and the working fluid. On account of this, if the macroscopic flow rate of the working fluid circulating through the fluid container 11 is periodically varied (including the flow rate of zero (0)), an amount of heat exchange between the heater 12 or the cooler 13 and the working fluid increases, so that it is possible to increase the operational efficiency, that is, the energy conversion efficiency of the steam engine 10.

Seventh Embodiment

Figure 9:
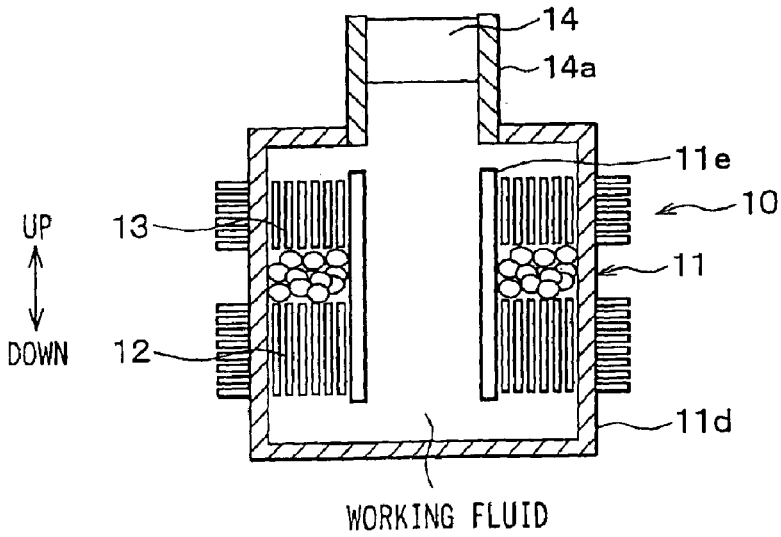
FIG. 9 is a schematic view of a steam engine according to a seventh embodiment of the present invention.

The pipe-shaped fluid container 11 takes the shape of a ring in the fifth and sixth embodiments. In a seventh embodiment, as shown in FIG. 9, the fluid container 11 takes the shape of a double cylinder, which comprises an outer cylinder 11*d* and an inner cylinder 11*e* coupled in the upper and lower ends to form a ring-shaped fluid path.

If the working fluid in the inner cylinder 11*e* exchanges heat with the working fluid between the inner cylinder 11*e* and the outer cylinder 11*d*, an amount of output mechanical energy decreases due to a decrease in an amount of expansion. Thus, it is preferable to take a measure such as to make the inner cylinder 11*e* of a material with a low thermal conductivity such as stainless, titanium or the like, to make the inner cylinder 11*e* of a double tube, the inside of which is evacuated, or the like.

Eighth Embodiment

In the foregoing embodiments, when the piston 14 protrudes with part of the expansion energy of the steam generated by the steam engine 10, the spring 3 in the generator 1 returns the piston 14 to its original position. In an eighth embodiment, however, as shown in FIG. 10, a flywheel 3*a* returns the piston 14 to its original position when the piston 14 protrudes with part of the expansion energy of the steam generated in the steam engine 10.

Figure 10:
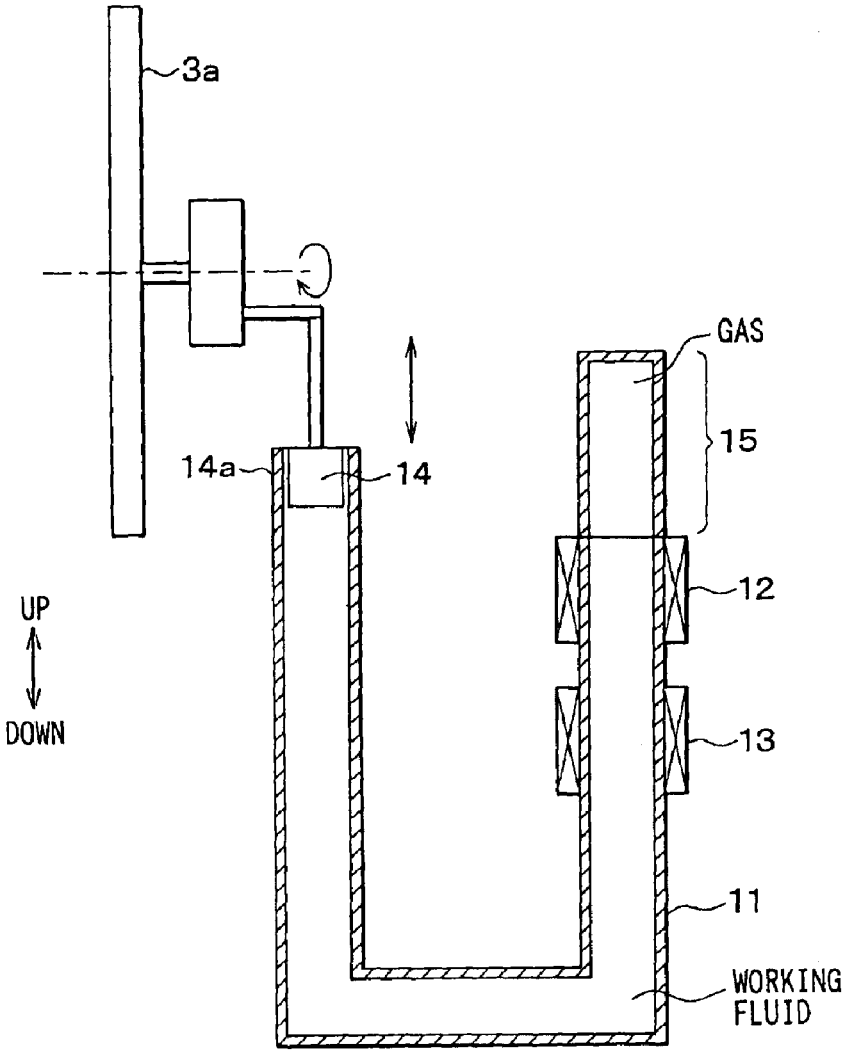
FIG. 10 is a schematic view of a steam engine according to an eighth embodiment of the present invention.

In FIG. 10, this embodiment is applied to the first embodiment, but this embodiment is not limited to this. This embodiment is applicable to the other embodiments.

Ninth Embodiment

In the foregoing embodiments, the output portion for outputting the displacement of excited vibration as the mechanical energy is composed of the piston 14, the cylinder portion 14*a*, and the like. In a ninth embodiment, as shown in FIG. 11, the output portion is composed of a membrane 14*b* which is displaced in accordance with pressure in the fluid container 11.

Figure 11:
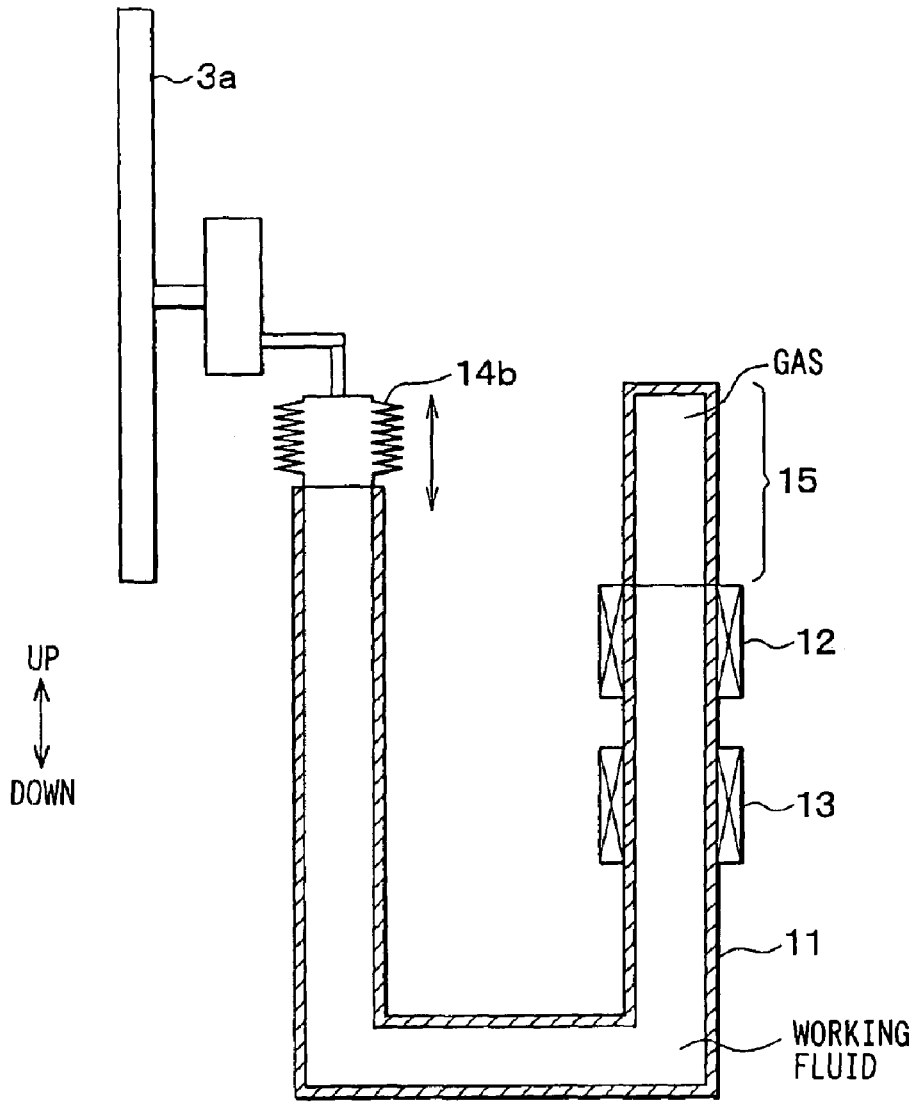
FIG. 11 is a schematic view of a steam engine according to a ninth embodiment of the present invention.
Figure 12:
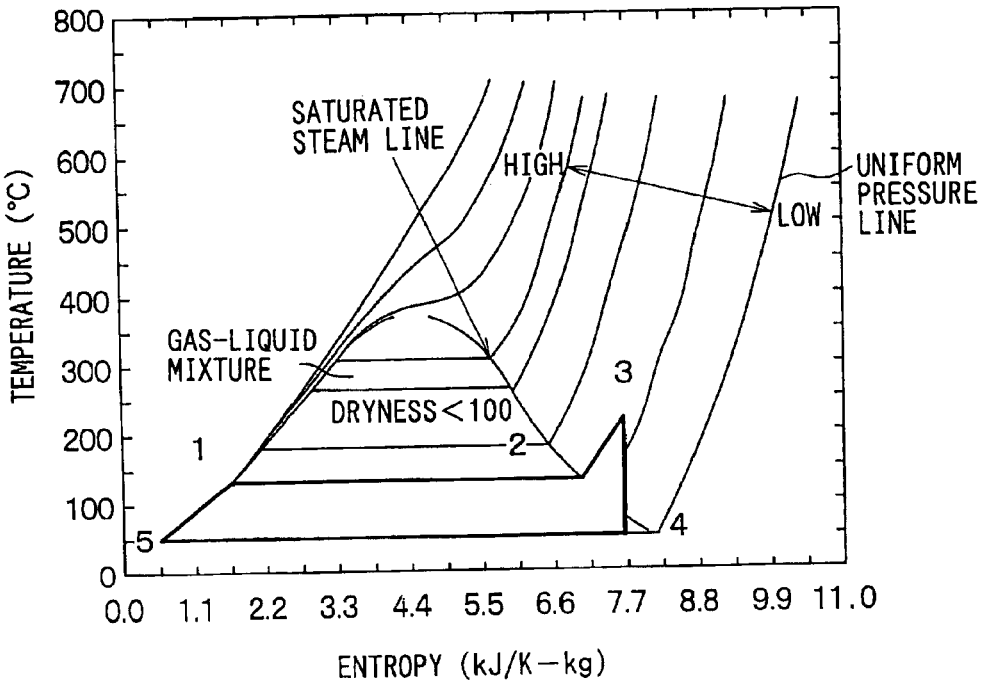
FIG. 12 PRIOR ART
FIG. 12 is a temperature-entropy diagram of a prior art engine.

In FIG. 11, the membrane 14*b* is an accordion-shaped bellows, but this embodiment is not limited to this. The membrane 14*b* may be a simple film-shaped diaphragm. In FIG. 11, this embodiment is applied to the eighth embodiment, but is not limited to it. This embodiment is applicable to the other embodiments.

Other Embodiments

In the foregoing embodiments, the exciting means comprises the gas spring which is achieved by charging gas into the gas chamber 15, but the present invention is not limited to this. The exciting means may comprise elastic means having elasticity such as a coiled spring and the like.

In the foregoing embodiments, the present invention is applied to a driving unit of the generator set, but the application of the present invention is not limited to this. The present invention is applicable to another driving unit too.

In the first to fifth embodiments, the heater 12 and the cooler 13 are aligned in the vertical direction, but the arrangement thereof is not limited to this. The arrangement of the heater 12, the cooler 13, and the output portion (piston 14) is changeable as long as the heater 12, the cooler 13, and the output portion (piston 14) are arranged in this order in the vibration direction of the working fluid, and the generated steam does not reach the output portion (piston 14). The heater 12 and the cooler 13, for example, may be aligned in a horizontal direction or diagonal direction, and the output portion (piston 14) may be arranged below the heater 12 and the horizontal direction or diagonal direction, and the output cooler 13.

In the first to fifth embodiments, the gas chamber 15 is provided as the exciting means, but the embodiments are not limited to this. The exciting means may be omitted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A steam engine for converting thermal energy into mechanical energy at an output portion, comprising:

a fluid container for flowably containing fluid;

a heater for heating the fluid contained in the fluid container;

a cooler for cooling a vaporized portion of the fluid that was vaporized by being heated by the heater, the cooler being disposed below the heater in a direction of gravity's acceleration;

wherein an expansion pressure of the vaporized portion of the fluid displaces a flowing liquid portion of the fluid to output the mechanical energy, and the cooler cools and liquefies the vaporized portion of the fluid to displace the flowing liquid portion of the fluid contained in the fluid container with self-excited vibration;

exciting means disposed proximate to the heater, the exciting means applying a periodical exciting force to the fluid contained in the fluid container; and a piston that is actuated by the expansion pressure of the vaporized portion of the fluid.

2. The steam engine according to claim 1, wherein the exciting means applies force to the fluid contained in the fluid container in a cycle one-quarter cycle out of phase with a cycle of the self-exciting vibration generated in the fluid container.

3. The steam engine according to claim 1, wherein a regenerator is provided between the heater and the cooler, and the regenerator exchanges heat in the fluid contained in the fluid container.

4. The steam engine according to claim 1, wherein the fluid container is approximately formed in the shape of a U so that a bent pipe is positioned in the lowermost part thereof, and liquid is displaced back and forth in the bent pipe with self-excited vibration.

5. The steam engine according to claim 1, wherein the fluid container is formed in a double cylindrical shape so as to have an outer cylinder and an inner cylinder coupled to each other in the lower portions thereof, and fluid is displaced back and forth in a coupling tube for coupling the outer cylinder and the inner cylinder with self-excited vibration.

6. The steam engine according to claim 1, wherein the cooler and the heater are disposed separate from each other in the direction of gravity, and the output portion is provided proximate to the cooler.

7. The steam engine according to claim 1, wherein the output portion has any one of a piston and bellows displaced with vibration, output is taken out of the piston or bellows, the piston or bellows receives pressure from flowing liquid.

8. The steam engine according to claim 1, wherein the exciting means applies force to the fluid contained in the fluid container in a cycle out of phase with a cycle of the self-exciting vibration generated in the fluid container.

9. The steam engine according to claim 8, wherein the exciting means comprises:

a first gas chamber for containing a gas for directly applying the exciting force to the fluid contained in the fluid container; and a second gas chamber coupled to the first gas chamber via throttle means for generating a predetermined flowing resistance.

10. The steam engine according to claim 8, wherein force is applied to the fluid contained in the fluid container in the cycle out of phase, to extend time for heat exchange between the heater or the cooler and the fluid.

11. A steam engine for converting thermal energy into mechanical energy at an output portion, comprising:

a fluid container for flowably containing fluid;

a heater for heating the fluid contained in the fluid container;

a cooler for cooling a vaporized portion of the fluid that was vaporized by being heated by the heater, the cooler being disposed below the heater in a direction of gravity's acceleration;

wherein an expansion pressure of the vaporized portion of the fluid displaces a flowing liquid portion of the fluid to output the mechanical energy, and the cooler cools and liquefies the vaporized portion of the fluid to displace the flowing liquid portion of the fluid contained in the fluid container with self-excited vibration;

exciting means disposed proximate to the heater, the exciting means applying a periodical exciting force to the fluid contained in the fluid container; and a piston that is actuated by the expansion pressure of the vaporized portion of the fluid; wherein the exciting force is a reaction force of a compression of gas charged in a gastight enclosure, and the exciting means applies the exciting force to the fluid contained in the fluid container.

* * * * *